United States Patent [19]

Eckert

[11] 4,151,316

[45] Apr. 24, 1979

[54] FLAMEPROOFING OF POLYESTER FABRICS USING BROMINATED CYCLOALKANES

[75] Inventor: Rene A. Eckert, Simpsonville, S.C.

[73] Assignee: Chas. S. Tanner Co., Greenville, S.C.

[21] Appl. No.: 849,527

[22] Filed: Nov. 9, 1977

[51] Int. Cl.[2] ..... B05D 3/02

[52] U.S. Cl. ..... 427/381; 427/390 D; 427/394

[58] Field of Search ..... 427/390 D, 394, 381

[56] References Cited

U.S. PATENT DOCUMENTS

| | | | |
|---|---|---|---|
| 3,558,727 | 1/1971 | Jenkner et al. | 260/648 R |
| 3,877,974 | 4/1975 | Mischwtin | 427/390 X |
| 3,974,310 | 8/1976 | Mischwtin | 427/390 D |

FOREIGN PATENT DOCUMENTS

| | | | |
|---|---|---|---|
| 1292878 | 10/1972 | United Kingdom | 427/390 |

*Primary Examiner*—Michael R. Lusignan

*Attorney, Agent, or Firm*—Dressler, Goldsmith, Clement, Gordon & Shore, Ltd.

[57] ABSTRACT

Polyethylene terephthalate fiber-containing fabric is flameproofed by application of an aqueous suspension of finely divided particles consisting essentially of octagonal hexabromide formed by the incomplete bromination of cis, trans, trans cyclododecatriene to provide a mixture having a melting point in the range of 177°-191° C. determined by differential scanning colorimetry using a heating rate of 10° C. per minute. The treated fabric is dried and then heated with the octagonal hexabromide particles thereon to a temperature above the melting point of the mixture, but not in excess of about 200° C. for a period long enough to achieve adequate penetration (30 seconds), to cause the hexabromide particles to diffuse into the fibers of the fabric to maximize fire resistance and obtain proper fixation of the particles to the fabric in a manner providing durability to laundering with minimum damage to the fabric.

5 Claims, No Drawings

FLAMEPROOFING OF POLYESTER FABRICS USING BROMINATED CYCLOALKANES

The present invention relates to the flameproofing of polyester fabrics using brominated cycloalkanes.

The need to flameproof fabrics containing polyester fibers is well recognized, as is the applicability of various organic bromine-containing compounds for this purpose, including brominated cycloalkanes containing from 7 to 12 ring carbon atoms and from 4 to 6 bromine atoms per molecule. Unfortunately, the greatest flame retardancy is provided by the highest melting brominated compounds, and the higher the melting point, the higher the temperature which is required to melt the agent and render it sufficiently fluid to flow into the interstices of the multifilament yarns constituting the fabric. These higher temperatures damage the polyester fibers causing the fibers to discolor and lose desirable handle, but when the melting point of the brominated compound is lowered the flame retardency is reduced.

In accordance with this invention, it has been found that when the brominated cycloalkanes which are applied to the polyester fabric from aqueous suspension consist essentially of octagonal hexabromide derived from the bromination of cis, trans, trans cyclododecatriene in admixture with a small proportion of incompletely brominated derivatives thereof providing a mixture having a melting point in the range of 177°-191° C. determined by differential scanning colorimetry, using a heating rate of 10° C. per minute, then when the polyester fabric with the particles of the mixture thereon is heated above the melting point of the mixture, but not in excess of about 200° C. for 30 seconds, the fire resistance of the polyester fabric in a manner providing durability to laundering is obtained, and minimum damage is inflicted upon the fabric.

The polyesters which are particularly contemplated herein are produced by the polyesterification of ethylene glycol with terephthalic acid to form a high molecular weight polyethylene terephthalate, but other fibers of similar characteristic can be made fire resistant by the same treatment. These fibers are frequently used in the manufacture of childern's sleepware, so the achievement of effective fire resistance is a significant goal.

Cis, trans, trans cyclododecatriene is produced from 1,3-butadiene which provides a mixture of cyclic polyethylenic hydrocarbons. In this invention, cis, trans, trans cyclododecatriene is separated from the mixture of polyethylenic hydrocarbons which is formed, and it is the separated cis, trans, trans isomer which is brominated for use in this invention. The bromination reaction can be carried out as illustated in U.S. Pat. No. 3,558,727 dated Jan. 26, 1971, the only requirement being that the reaction be monitored and continued until the product has the desired melting point, at which point the bromination reaction must be stopped to prevent the melting point from becoming excessive.

When bromination of the cis, trans, trans isomer is complete, and after recrystallization from ethyl acetate to remove impurities, there is formed a pure octagonal hexabromide having a melting point (determined in the same way referred to hereinbefore) of about 210°-212° C., and the melting of such a material at a temperature high enough and for a time long enough (usually about 30 seconds) to provide sufficient fluidity to penetrate the polyester fibers of the fabric would cause significant damage to the fabric.

The cis, trans, trans cyclododecatriene which is brominated should be substantially pure, which means that no more than about 5% by weight of other isomers may be present. Bromination to provide a melting point in the range of 177°-191° C. requires that most of the cyclododecatriene be converted to the octagonal hexabromide. While only a small proportion of incompletely brominated cyclododecatriene has a pronounced effect in providing the needed reduction in melting point, it is easily detected because the incompletely brominated species exhibits absorption in the ultraviolet at 306 nanometers, while the octagonal hexabromide does not.

The hexabromide mixture which is used herein is a solid which is applied to the fabric from an aqueous suspension as taught in German Offenlegungsschrift No. 2,001,125 published Sept. 17, 1970 which corresponds to British Pat. No. 1,292,878 dated Oct. 18, 1972. Defensive Publication T896,010 published Mar. 7, 1972 will further illustrate the early teachings in this art. While the application of brominated compounds to polyester fabrics from aqueous suspension is not new herein, the need to employ a system which is essentially free of extraneous materials which will lower the melting point of the suspended brominated organic compound (such as organic solvents) constitutes a part of the problem to which this invention is addressed.

The particle size of the dispersed bromine-containing particles is not of primary concern, except that the finer the particle the easier it is to disperse it in water, and the more uniformly will the particles be distributed over the fabric being treated. On this basis a particle size of from about 1 to about 30 microns is broadly suitable, and the smaller sizes are preferred.

The high melting octagonal hexabromide mixture is dispersed in water in finely divided form in the substantial absence of agents which will further lower the melting characteristics of the suspended hexabromide particles. This is because such agents can attack the polyester fibers at the elevated fusion temperatures used herein so as to reduce the strength or impair the hand of the fabric. The mixture may be preground and then dispersed in water containing a suitable dispersant, but it is more convenient to grind the mixture in water containing the dispersant until the desired average particle size is obtained.

Suitable dispersants to enable water to wet the particles of octagonal hexabromide mixture are themselves known for this purpose. Ionic surfactants, and especially anionic surfactants such as sulfonates and sulfates of hydrophobic organic compounds are preferred. These are illustrated by lignin sulphonates, aromatic sulfonic acids and particularly the condensation product of aromatic sulfonic acids, such as naphthalene sulfonic acid, with formaldehyde. This condensation product will be used hereinafter to illustrate the invention. Sodium lauryl sulfate, sulfated fatty alcohols, sulfated substituted benzimidazoles and sulfonated fatty acid amides will further illustrate useful anionic surfactants. Cationic surfactants are illustrated by quaternary ammonium salts such as palmitamidoethyl diethyl gamma-hydroxy-propyl ammonium chloride. The nonionic surfactants are ethylene oxide adducts of hydrophobic organic compounds, and these tend to act as plasticizers. Hence, while broadly useful, the amount of use must be restricted, and these are less preferred.

The surfactant may be used in an amount of from 0.5-10%, based on the weight of the particles to be suspended, and it is preferred to use as little as is required to provide the desired wetting.

Storage stability can also be improved using protective colloids, such as hydroxyethyl cellulose or carboxymethyl cellulose, but these are optional. From 0.5–10% by weight of the mixture being suspended may be used to increase viscosity and thereby provide the desired stability.

Application of the aqueous dispersion of octagonal hexabromide mixture particles to the polyester fabric can be carried out in diverse ways. Thus, the dispersion can be diluted for handling and sprayed on one or both faces of the fabric or padded thereon at any desired temperature from room temperature to the boiling point of the water under the conditions of application. It is even possible to immerse the fabric in the dispersion. One or several applications can be made until the fabric has deposited thereon the desired weight of flame retardant particles. Of course, the water is removed by drying before the weight of deposited solids is measured. From 0.5% to about 10% of the treated fabric should be constituted by the flame retardant particles, it being preferred to deposit from 1–3% of bromine on the fabric.

The temperature of drying is not important, but the higher the temperature, the faster the water will volatilize. On the same basis, the temperature of the dispersion which is applied is also unimportant.

The heat treatment which melts the octagonal hexbromide particles and causes the molten material to be absrobed into the polyester fibers must be at least sufficient to produce the desired melting, and this lower temperature will depend upon the melting point of the brominated mixture within the narrow range of 177°–191° C. The heat treatment should not exceed about 200° C. for about 30 seconds because this degrades the polyester fiber. More particularly, when too high a temperature is applied or when the time of application is excessive, the polyester fiber discolors and loses some of its strength and good handle properties. The heat treatment in this invention will thus have a duration of about 10 seconds to about 120 seconds, depending on oven temperature, but is preferably in the range of about 20 seconds to about 80 seconds.

The octagonal hexabromide mixture aqueous suspension may also contain ancillary treatment materials, such as dyes or fluorescent brighteners.

The invention is illustrated in the following examples.

EXAMPLE 1

Substantially pure cis, trans, trans cyclododecatriene (97% selected isomer-balance other isomers) is brominated as described in U.S. Pat. No. 3,558,727 to provide a product having a melting point, as determined by differential scanning colorimetry (heating at 10° C. per minute) of 191° C. This product is largely constituted by an hexabromide which forms an octagonal crystal which does not absorb ultraviolet light at 306 nanometers and which melts at about 210°–212° C. determined in the same way. The product, however, is a mixture of lower melting point in which incompletely brominated materials cause the mixture to absorb ultraviolet light at 306 nanometers. Tetrabrominated cyclododecatriene is strongly absorptive at 306 nanometers, and the absorption and lowered melting point of the mixture is attributed to the presence of a small proportion of this incompletely brominated species.

EXAMPLE 2

220 grams of the finely divided product of Example 1 are dispersed in a solution of 8 grams of a condensation product of naphthalene sulfonic acid and formaldehyde in 172 grams of water and the suspension is ground in a ball mill to an average particle size of about 2 microns. To stabilize this suspension there is added with stirring 40 grams of a 5% aqueous solution of carboxymethyl cellulose (degree of etherification =0.85; viscosity of 1% solution =10–20 centipoise). A readily pourable storable suspension is provided.

EXAMPLE 3

A woven fabric constituted by polyethylene terephthalate fibers having a weight per unit area of 150 grams per square meter is padded with the suspension of Example 2 diluted with water to 35% by weight of brominated organic compound. The treated fabric is dried for 3 minutes at about 80° C. to remove the water and leave the particles of octagonal hexabromide on the fabric. The dried fabric is then passed through an oven maintained at 200° C., the fabric remaining in the oven about 30 seconds, to cause the hexabromide particles to diffuse into the fabric. The fabric is then washed for 5 minutes at 60° C. in an aqueous liquor containing 2 grams per liter of anhydrous sodium carbonate and 1 gram per liter of a condensation product of 1 mole of p-nonyl phenol and 9 moles of ethylene oxide. The washed fabric is then rinsed and dried and contains about 3% by weight of bromine.

The finished fabric is flame retardant, passing children's sleepwear flammability standard DOC FF3-71 and the color and handle of the fabric are substantially unimpaired.

I claim:

1. A process for flameproofing polyethylene terephthalate fiber-containing fabric comprising applying to said fabric an aqueous suspension of finely divided particles consisting essentially of octagonal hexabromide formed by the incomplete bromination of cis, trans, trans cyclododecatriene containing not more than about 5% by weight of other isomers, said incomplete bromination providing a mixture having a melting point in the range of 177°–191° C. determined by differential scanning colorimetry using a heating rate of 10° C. per minute, drying said fabric and then heating the fabric with said octagonal hexabromide particles thereon to a temperature above the melting point of the mixture, but not in excess of about 200° C. for about 30 seconds, whereby the hexabromide particles diffuse into the fibers of the fabric to maximize fire resistance while fixing the particles to the fabric with minimum damage to the fabric.

2. A process as recited in claim 1 in which said aqueous suspension includes from 0.5–10% of anionic surfactant, based on the weight of the suspended octagonal hexabromide particles.

3. A process as recited in claim 1 in which said aqueous suspension includes from 0.5–10% of the thickener.

4. A process as recited in claim 3 in which said thickener is carboxymethyl cellulose.

5. A process as recited in claim 4 in which said aqueous suspension includes the condensation product of naphthalene sulfonic acid and formaldehyde as anionic surfactant.

* * * * *